US005915698A

United States Patent [19]

James

[11] Patent Number: 5,915,698

[45] Date of Patent: Jun. 29, 1999

[54] RESILIENT WIRE CLIPS WITH MULTIPLE PAIR SECTIONS AND CROSSED ENDS FOR ATTACHING A TUBULAR BRAIDED GASKET TO AN OVEN DOOR HAVING GROUPS OF CLIP RECEIVING APERTURES AT VARIABLE INTERVALS

[75] Inventor: Benjamin B. James, Birchrunville, Pa.

[73] Assignee: Federal-Mogul Systems Protection Group, Inc., Exton, Pa.

[21] Appl. No.: 08/683,681

[22] Filed: Jul. 17, 1996

[51] Int. Cl.[6] ..... F16J 15/02

[52] U.S. Cl. ..... 277/637; 24/296; 49/492.1

[58] Field of Search ..... 49/492.1, 475.1; 24/289, 293, 296; 277/637, 640, 650, 651, 652; 52/718.07, 742.11; 403/332

[56] References Cited

U.S. PATENT DOCUMENTS

| | | | |
|---|---|---|---|
| 2,099,189 | 11/1937 | Ball | 24/296 X |
| 2,254,310 | 9/1941 | Place | 24/296 X |
| 3,167,824 | 2/1965 | Berwanger | 49/492.1 X |
| 4,538,381 | 9/1985 | Vogel | 49/479 |
| 4,822,060 | 4/1989 | Moyer et al. | 277/640 |
| 4,986,033 | 1/1991 | Weil | 49/492 |
| 5,107,623 | 4/1992 | Weil | 49/485 |
| 5,205,075 | 4/1993 | Moyer | 49/492.1 X |
| 5,289,658 | 3/1994 | Lusen et al. | 49/492.1 |
| 5,341,601 | 8/1994 | Moyer | 49/493.1 |
| 5,395,126 | 3/1995 | Tresslar | 277/637 |

FOREIGN PATENT DOCUMENTS

WO 98/03822 1/1998 WIPO .

*Primary Examiner*—Anthony Knight
*Assistant Examiner*—Greg Binda
*Attorney, Agent, or Firm*—Synnestvedt & Lechner

[57] ABSTRACT

An oven door seal comprises a braided tubular gasket of wire and a mineral fiber, such as glass fiber, a ceramic or quartz or mixtures thereof. The gasket has the characteristic of a braided structure of radial expansion upon axial compression and radial contraction upon axial extension. Clips of resilient wire are prebent in a common plane so as to have an apexed head formed near the mid point of the wire intermediate parallel sections and crossing end sections are disclosed. The clips are inserted into the gasket with the crossing ends spanning one or more filaments in the lattice structure of the braided tubular gasket and the crossing ends pass through the wall structure and are deflected generally parallel to the wall as the clip wire sections at the apex flex together. The apertures are formed in the oven door perimeter at different spacings depending upon the gasket diameter desired along the edge having a particular spacing and the clip inserted at equal spacings in an oven door. The installed gasket may have a smaller diameter along the hinge side of the door and a larger diameter along the side most remote from the door on account of the variable spacing of the apertures.

12 Claims, 2 Drawing Sheets

RESILIENT WIRE CLIPS WITH MULTIPLE PAIR SECTIONS AND CROSSED ENDS FOR ATTACHING A TUBULAR BRAIDED GASKET TO AN OVEN DOOR HAVING GROUPS OF CLIP RECEIVING APERTURES AT VARIABLE INTERVALS

FIELD OF THE INVENTION

This invention relates to tubular gaskets and to the means for attachment of the gaskets to one surface which is relatively moveable with respect to a second surface. The gaskets of this invention are comprised of wire and a thermally insulating yarn which may be a separate cover for the wire or may be interbraided therewith and, while not to be limited thereto, are especially useful for high temperature applications, such as oven door seals.

BACKGROUND OF THE INVENTION

Woven tubular gaskets have been used for the principal purpose of oven door seals for many years. These gaskets are typically made from a combination of an inner tubular support member formed of knitted wire and an outer tubular member made either by braiding, knitting or weaving from an insulating material such as glass fiber yarn. Such structures have proven to be durable at the high temperatures used in self-cleaning ovens and provide a good seal despite repeated openings and closures of the oven door over many years of use. An inner tubular member, sometimes called a bulb, provides the necessary resilient support of the glass fiber tubular gasket. Various methods of attaching the knitted wire tubular gasket to ovens or oven doors have typically comprised providing a retaining member which extends along the gasket and locking the retaining member between sheet metal pieces of the oven door or by providing clamps at spaced locations around the periphery of the gasket. Examples of such oven gaskets and their attachment are shown in U.S. Pat. No. 2,219,962 to Reynolds et al; U.S. Pat. No. 3,578,764 to Nunnally et al; U.S. Pat. No. 3,812,316 to Milburn; U.S. Pat. No. 3,846,608 to Valles; and U.S. Pat. No. 4,122,323 to Stats.

An alternative form of gasket having attachment means comprised of a wireform having spaced attachment protrusions which fit into corresponding apertures in a surface to which the gasket is to be attached is shown in U.S. Pat. Nos. 4,822,060 and 5,395,126. In the '126 patent, the interior support core is eliminated. Wire interbraided with glass fiber forms a support matrix which also locks the protrusions in place.

Although gaskets of the above patents are effective for their intended purpose, fabrication requires a relatively high level of skill which makes the product relatively expensive. A problem may arise in the production of gaskets of the '060 patent owing to the difficulty of insertion of the wireform carrying the protrusions through the knitted tubular wire bulb and then in the passage of the protrusions through the bulb and the overlayer of braided gasket material. Not only does the insertion of the wireform tend to be a difficult task to accomplish, the passage of the protrusions through the exterior gasket layer may tear the individual strands of glass fiber if not carefully done, resulting in a potentially undesirable scrap rate. Further, because the surfaces to which the gaskets are to be attached have attachment apertures preformed at different spacings for different products, a range of wireforms having different spacings for the attachment protrusions must be provided.

Still another form of attachment means comprises individual clips as disclosed, for example, in U.S. Pat. Nos. 4,986,033, 5,107,623 and 5,205,075. The '075 patent discloses a clip having an apex and pointed ends which are bent laterally so as to project between an interknitted bulb and an outer gasket layer. The interknitted bulb is effective to maintain the clips in an upright position so that the pointed ends extend outwardly from the gasket in a radial direction in order to facilitate insertion into the apertures formed in one of the oven surfaces.

Clips of the type shown in the '075 patent are inserted from the interior of the gasket and passed through the exterior gasket wall and may be inserted at variable spacing along the gasket. However, radial expansion and contraction of the braid with corresponding axial contractions and expansions is not suggested in conjunction with variable aperture or clip spacing as a means of providing a gasket of varying diameter.

SUMMARY OF THE INVENTION

According to the invention, a gasket is provided which is comprised of glass fiber yarn or yarn of other suitable thermally insulating fiber and a flexible and resilient wire. In carrying out the invention, the resilient wire and the thermally insulating yarn are utilized to form the gasket by braiding. The wire may be braided to form an open matrix of crossing wires with a separate cover of the glass fiber or other thermally insulating yarn, but it is preferable that the yarn and the wire be braided together. In either case, the wire in the braid forms a relatively open support matrix for the yarn. Such a gasket has the well-known property of being radially expandable upon axial compression of the structure and to radially contract upon elongation of the braided structure. Although any braided structure inherently has the property of variable radial expansion and contraction as a function of axial contraction and expansion, the degree of radial change will vary according to the tightness of the braid, the presence or absence of a supporting core or the use of relatively inflexible coatings or binders. It is to be understood and expected that the degree of radial change appropriate for a particular product application can be determined by one of ordinary skill in the art after a few field trials.

In accordance with the invention, individual wire clips are formed from wire sections of a relatively resilient wire which can be preformed with relatively simple tools at preformed bend points so as to form at one end an apexed head and at the opposite end a pair of crossing end sections. Preferably, the crossing end sections are formed with zigzag bends which serve as stabilizing platforms for the clips when the end sections are passed through the gasket side wall.

An important advantage of the use of clips of the type just described in a braided structure is that by variably spacing the clips or the apertures in which the apexed head portions are inserted, a single gasket whose diameter is larger or smaller, as required, is readily and economically provided. For example, it is desirable that the gasket have a smaller diameter adjacent the hinge of an oven door than along the surface opposite to the hinge. To accomplish this according to the invention, the apertures are spaced further apart on the hinged side than the opposite side and the clips are equidistantly spaced along the gasket. By gradually decreasing the aperture spacing along the adjoining sides, sections with a tapered gasket are provided extending between the hinge side and the opposite side. Alternatively, the same objective can be accomplished by varying the spacing between insertion points of the clips into the gasket while allowing the apertures in the door perimeter to be uniformly spaced. The invention eliminates the need to preform gaskets in tapered shape, or the need to manufacture and install gasket sections of different diameter, thus simplifying gasket fabrication while allowing for maximum variation in diameter of the gasket in accordance with the customers requirements.

The clips formed in accordance with the invention are simple to manufacture, can be dispensed from magazines and require a relatively low insertion force when attached to the gaskets.

DETAILED DESCRIPTION OF THE PREFERRED EMBODIMENT

Figure 1:
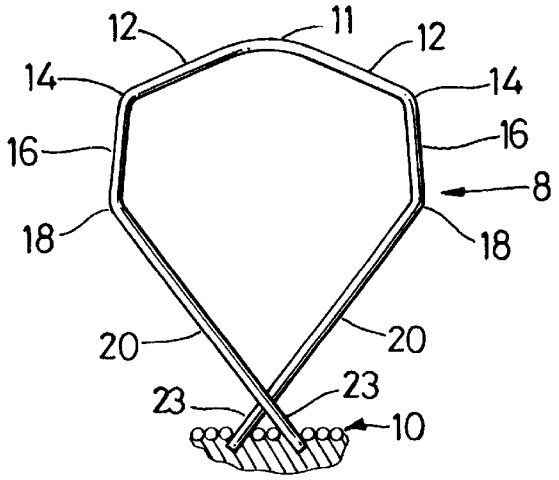
FIG. 1 is a side view of a clip incorporating the principles of the invention.

Referring first to FIG. 1, a clip 8 of preferred form is shown at the initiation of insertion through the side wall of a braided tubular gasket, a fragment of which is shown at 10. Each clip is formed of a separate piece of a formable wire which is preferably full hard stainless steel having a relatively high flexural modulus as compared with materials such as common office-type staples or paper clips. Each clip is preformed so that it is bent intermediate its ends to form an apex 11 from which a pair of relatively outwardly inclining substantially straight sections 12 extend to a first pair of preformed bends or shoulders 14.

Immediately following each preformed bend 14, substantially parallel sections 16 extend to a second pair of preformed bends 18. Thereafter, end sections 20 extend inwardly to terminate in crossing ends 23. In general, clip 8 comprises a first pointed end or head portion 11 formed at the preformed bend 11 and by a pair of diverging relatively straight sections 12 followed by substantially parallel sections 16 and inwardly angled end sections 20 which terminate in crossing ends 23. All bends are preferably formed substantially in a common plane.

In the exemplary embodiment, the angle formed between the wire sections forming bend 11 is initially about 140°, the angle at the preformed bends 14 is about 120° and the angle at preformed bends 18 is about 140°.

Figure 4:
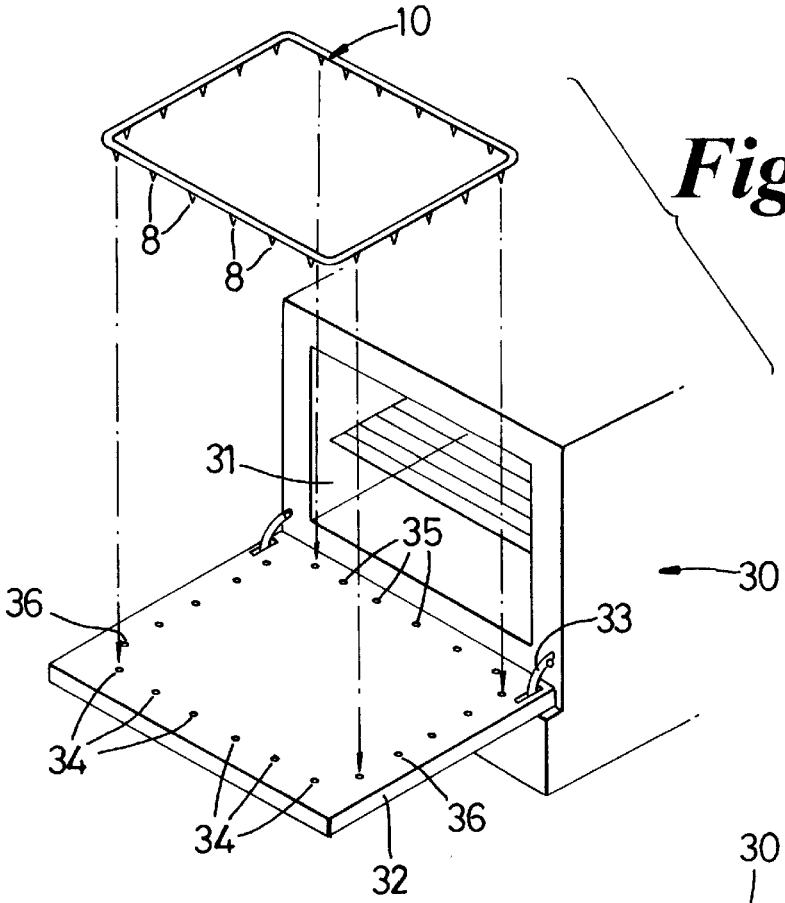
FIG. 4 is a assembly view in perspective showing the installation on an oven door of a gasket equipped with clips of the kind shown in FIGS. 1–3.

With reference to FIG. 4, the clips 8 serve as attachment means for gaskets 10 which are of the type particularly suited for sealing the space between the door 32 of the chamber 31 of an oven 30 and, in particular, to gaskets for sealing doors of self-cleaning ovens where the gaskets are exposed to the relatively high temperatures prevailing during a cleaning operation. To this end, the tubular gaskets 10 are formed of materials such as stainless steel wire and a thermally resistant, insulating material which is typically provided in multifilament form such as a yarn of spun glass fiber or yarns of ceramic, quartz or related materials characterized by low thermal conductivity. For the sealing of oven doors, a preferred material is glass fiber yarn because of its low cost, durability and excellent thermal insulating properties. In addition, the glass yarn has excellent flexibility and resists degradation at the relatively high temperatures to which it is exposed during the cleaning cycle of high temperature ovens.

In the exemplary form of the invention, the glass fiber yarn is braided together with single filament wire. Preferably, the wire employed is full hard stainless steel wire of a diameter of about 9 mils in a typical household-type oven door application. Other metallic wires may be employed so long as these materials are relatively flexible and resilient so as to allow for repeated compression and provide the capacity to repeatedly return to original shape, despite exposure to thousands of cycles during the lifetime of an oven.

In carrying out the invention, the wire and glass fiber are interbraided on a circular braider, as illustrated for example, in U.S. Pat. No. 5,395,127, which is incorporated herein by reference. As explained in that patent, the yarn and wire are loaded on separate carriers on the braider. A preferred braided structure is braided using 24 carriers of wire and 48 carriers of glass fiber yarn in a 72 carrier circular braider. Variations in the proportions of wire and yarn may be employed, a preferred range being from about 25% wire to about 75% yarn up to about 50% wire to about 50% yarn. Preferably, the yarn employed is a continuous multifilament yarn of E glass, such as type E373 supplied by the Owens Corning Fiberglass Company. Stainless steel wire of a diameter of about 9 mils is employed in the illustrative embodiment, although the diameter of the wire may vary in a range from about 3 mils to about 15 mils in the production of gaskets for the doors of self-cleaning ovens.

As will be explained more fully in what follows, an important consideration in the design of the gasket is that the property of a braided structure of being radially expandable or contractible in accordance with axial compression or extension be relatively unimpaired. To this end, the braided structure should not be braided too tightly and inflexible coatings or coverings which may impair the relative movement of the crossing filaments should be avoided.

Figure 2:
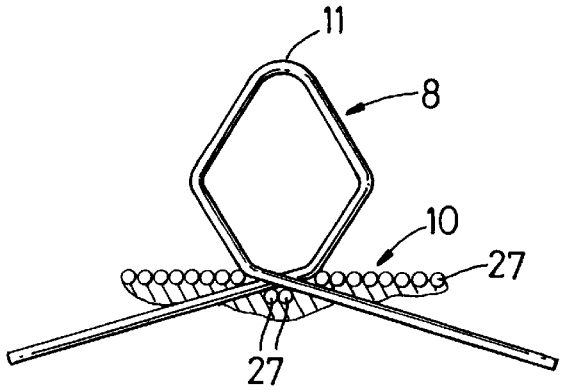
FIG. 2 is a side view of the clip of FIG. 1 showing partial insertion through the side wall of a braided tubular gasket.
Figure 2A:
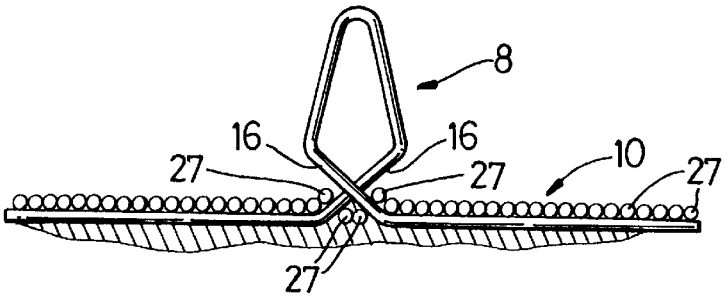
FIG. 2A is a side view of the clip of FIGS. 1 and 2 following insertion through the gasket side wall.
Figure 3:
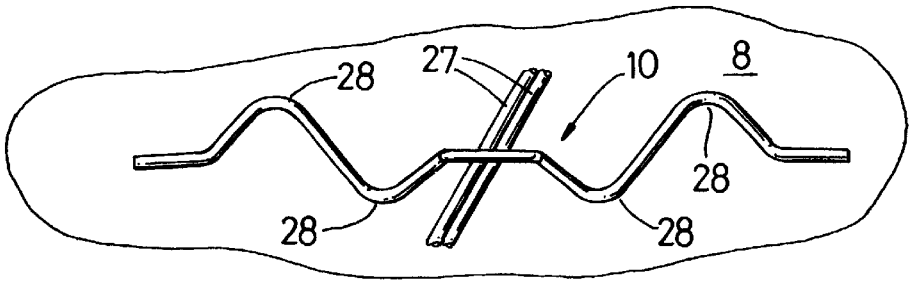
FIG. 3 is a plan view of the inserted clip of FIG. 2A.

With reference to FIGS. 1–3, the crossing ends of a clip 8 are inserted through the gasket wall so that they span at least one and preferably more of the crossing wires or filaments 27. In inserting the clip through the gasket side wall, the wire sections forming preformed bend 11 flex together as the crossing ends are spread apart by pressure applied against the spanned filaments. As insertion pressure is continued, the angle at the apex becomes more acute (FIG. 2) while the angles of the wire sections forming preformed bends 14 remain substantially constant and crossing end sections 16 extended in opposite directions and finally assume positions extending substantially parallel to the gasket wall, as viewed in FIG. 2*a*.

Preferably, in order to provide a stabilizing platform for the clip so that it is maintained in a position projecting substantially radially of the gasket wall, the end sections are formed with one or more zigzag bends 28 extending transversely to the plane of the pointed head, as shown in FIG. 3.

When in the fully inserted position of FIG. 3, the clip is locked in place by the adjacent filaments 27 adjacent to and spaced just outwardly from crossing wire sections 16. The wire of each clip possesses sufficient resilience so that when pressure on the sections 12 is relaxed, the bends flex outwardly somewhat and bear against the filaments 27.

Figure 5:
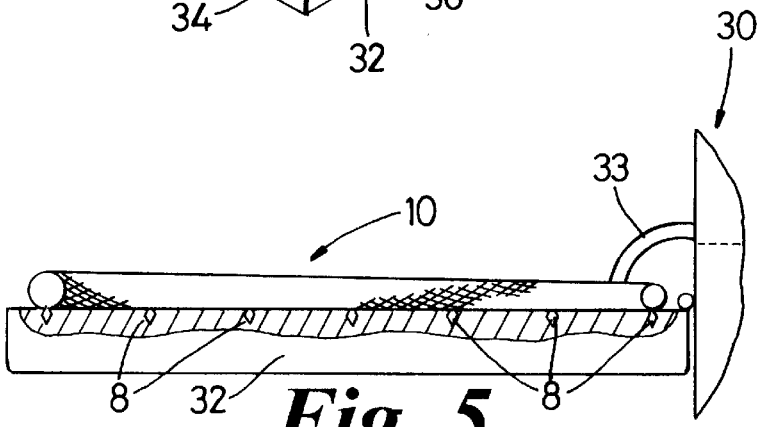
FIG. 5 is a side view of a gasket formed according to FIGS. 1–4, further illustrating installation in an oven door.

With reference to FIGS. 4 and 5, the installation of a gasket in order to achieve the desired beneficial gasket shape is illustrated. In sealing the oven chamber 31, a better seal is considered to be achieved if the portion of the gasket extending along the side of the chamber remote from the hinges is of larger diameter than the portion of the gasket along the side where the door is hinged. In the preferred form of carrying out the invention, the gasket is a braided gasket having the inherent property of radial expansion upon axial compression, and the periphery of the door is provided with apertures of different spacing according to whether it is desired that the gasket be of larger or smaller diameter. In FIGS. 4 and 5, an oven 30 in which an oven chamber 31 is located is provided with a door 32 hingedly attached to the oven by hinges 33. The oven door 32 is provided with a peripheral surface having a first series of apertures 34 along the side remote from the hinge side which are equally spaced apart a fixed distance. Apertures 35 are formed in the peripheral surface along the hinge side in a second series spaced apart by a second value which is a larger value than the first spacing of the series. Apertures 36 provided in the side surfaces of the door which interface with the sides of the oven chamber may be spaced apart by amounts which increase by graduated increments, for example, starting with a spacing which is equal to the spacing between apertures 34 for the apertures spaced furthest from the hinges to a spacing about equal to the spacing between the apertures 35 for those nearest the hinge side. In this way, by providing the clips at uniform spacings along a length of gasket, when the clip heads are inserted into the apertures, as shown in FIG. 5, the gasket is compressed most and, accordingly, of greatest diameter away from the hinge and of least diameter at the hinged side.

Alternatively, all apertures extending around the periphery of the oven door may be equally spaced around the perimeter of the door and the clips inserted into the gasket at preselected differential spacing so as to cause the gasket to be axially compressed to produce radial expansion along the surface most remote from the hinged side of the door. This arrangement accommodates doors in which the apertures have been previously formed at uniform spacings.

In summary, individual clips and a clip system comprised of the clips has been provided for attachment to tubular gaskets, such as oven door gaskets or gaskets used in other high temperature applications. The clips are inserted in place in the gaskets without the need for special tools, such as mandrels inserted interiorly of the gasket for clenching the clip end sections. The clips are inserted by spanning one or more filaments of the gasket and pressing relatively inwardly so that the clip apex is flexed from a relatively wide angle to a relatively sharp angle as the wire end sections project into the gasket and in opposite directions parallel to the gasket wall. When the end sections are in the extended position, the clip is locked in place between the interlocking gasket filaments. When applied to one of the interfacing surfaces which are intended to be sealed, the diameter of the gasket may be varied either by varying the spacing between clips or varying the spacing between apertures on the surface to which the clips are attached. The clips are locked in place, stand proud of the gasket for ease of insertion and are easy to manufacture and easy to attach to the gaskets with relatively unskilled labor.

I claim:

1. A clip system for securing a braided gasket comprised of a tubular sidewall of interbraided wire filaments, said braided gasket being radially expanded upon axial contraction and being securable to one of a pair of relatively movable interengagable surfaces, wherein one of said surfaces has spaced apertures for insertion of individual clips affixed to said gasket, said clip system comprising:

a plurality of individual clips each comprised of a unitary wire being flexible and formable having a relatively high modulus, said wire having a centrally located first bend and first pair of wire sections diverging from said first bend to form a head portion, said first pair of wire sections being subject to flexure from a first angular position to a second angular position in which the first and second wire sections are disposed at an angle which is acute relative to the angle at the first angular position;

a second pair of wire sections integrally joined to the first pair of wire sections, said second pair of wire sections extended from the first pair of wire sections and being substantially in parallel relationship when the first pair of wire sections is in the first angular position;

a third pair of wire sections integrally joined to and inclining inwardly from the second pair, said third pair of wire sections terminating in crossing ends spanning at least one of said wire filaments when the first pair of wire sections are in said first angular position, said third pair of wire sections being extended in opposite directions lengthwise of the gasket and said second pair of wire sections being moved into crossing relationship upon flexure of the first wire portions to said second angular position, said first wire portions being flexed to said second angular position upon application of radially directed inward pressure against at least one of said filaments spanned by said crossing ends, said pressure being applied with sufficient force to flex said first pair of wire sections from said first to said second angular position.

2. A clip system according to claim 1, wherein said clips are inserted at equal intervals lengthwise of the gasket.

3. A clip system according to claim 2, wherein the clip-receiving apertures are spaced apart predetermined distances on said one of said surfaces.

4. A clip system according to claim 3, wherein said one of said surfaces has at least one section wherein the spacing between apertures is greater than the spacing of the remainder of the apertures.

5. A clip system according to claim 4, wherein said one of said surfaces is formed at the periphery of an oven door having hinges hingedly secured to the oven and wherein the said at least one section is disposed adjacent to the hinges.

6. A clip according to claim 1, wherein the wire sections of the third pair are provided with bends which extend in a plane transversely of the plane of said head portion.

7. A clip according to claim 6, wherein the wire sections of the second pair are straight sections.

8. A clip according to claim 6, wherein the flexible, formable, relatively high modulus wire is a stainless steel wire.

9. A flexible resilient clip for securing a tubular gasket comprised of braided filaments to one of a pair of interfacing surfaces, wherein one of said surfaces has spaced apertures for attachment of clips, each said clip comprising:

a flexible, formable, resilient wire including a first pair of wire sections, said wire sections diverging from an apex, said sections of said first pair being subject to flexure at the apex to resiliently move toward one another upon application of bending pressure and possessing sufficient resilience to return to said position upon release of said pressure, said first pair of wire sections ending in a second pair of wire sections integrally joined to the wire sections of the first pair, said second wire sections extending therefrom in substantially parallel relationship to a third pair of wire sections extending from the second pair, said third pair of wire sections being in converging relationship and being formed with crossing ends, said crossing ends being insertable through the tubular wall of gaskets on opposite sides of at least one of said crossing filaments by the application of a predetermined insertion pressure exerted radially inwardly of the tubular gasket, said predetermined insertion pressure producing flexure of the clip apex and extension of the third pair of wire sections, the second pair of wire sections being moved into crossing relationship when the third pair of wire sections extend in opposite directions lengthwise of the gasket, the braided filaments bearing against the second pair of wire sections to lock the clip in inserted position when the second pair of wire sections are in crossing relationship.

10. In combination a plurality of individual wire clips and a tubular gasket for thermally sealing a space between a first surface and a second surface, wherein one of said surfaces has a series of spaced apertures, said combination comprising:

(a) interwoven filaments of a flexible and resilient metal wire;

(b) an insulation yarn of flexible strand selected from the group consisting of ceramic, quartz and glass and mixtures thereof;

(c) said yarn and said wire forming a flexible tube having a unitary tubular wall with a hollow interior free of supporting substructure, the wire forming an open lattice of the crossing wires with openings therebetween, the crossing wires being free for relative movement toward and away from one another and the yarn substantially covering said openings;

(d) said plurality of individual wire clips for securing the gasket to said apertures, each said wire clip comprising a single discrete length of resilient, formable wire, each said discrete length having a plurality of preformed bends lying in a common plane, said clip being subject to flexure at said preformed bends, a first of said preformed bends being proximate the mid-point of each said discrete length, a pair of first wire sections inclining away from the first of said preformed bends, said first of said preformed bends and said pair of first straight wire sections defining an apex, said plurality of preformed bends further including a first pair of preformed bends joined to said first straight sections, a second pair of relatively straight sections extending substantially in parallel when the clip is unflexed from said first pair of preformed bends and terminating in a second pair of preformed bends, a third pair of wire sections joined to said second pair at said pair of second preformed bends, said third pair of wire sections terminating in crossing end points, said first pair of wire sections being subject to flexure at the first of said preformed bends to form a relatively acute angle;

the crossing end points being movable in opposite directions and the second pair of wire sections being moved into crossing relationship upon application of a predetermined insertion pressure against the at least one of said interwoven filaments spanned by said ends, said predetermined pressure causing flexure of the first of said preformed bends sufficient to form said relatively acute angle, the crossing second sections and the gasket filaments forming a means for interlocking the clips to the gasket.

11. In combination a plurality of individual wire clips and a tubular gasket for thermally sealing a space between a first surface and a second surface, said combination being comprised of:

filaments of a flexible and resilient metal wire and an insulation yarn of flexible strand selected from the group consisting of ceramic, quartz and glass and mixtures thereof;

said yarn and said wire being braided to form a braided tube with a hollow interior free of supporting substructure, said tube having crossing wires with openings therebetween, the crossing wires being free for relative movement toward and away from one another upon axial expansion and contraction of the tube and the yarn substantially covering said openings, said tube being radially expandable upon axial contraction and being radially contractible upon axial expansion;

said plurality of individual wire clips attached to said gasket at uniformly spaced intervals lengthwise thereof, said wire clips each being comprised of a unitary wire, said wire being flexible and bendable and having a relatively high modulus, said wire clips each having a head portion projecting from the gasket; and spaced apertures extended along one of said surfaces, said apertures being dimensioned to receive said head portions and including first and second groups, one said group being spaced at intervals different from a second of said groups.

12. A combination according to claim 11, wherein said head portion comprises a pair of first wire sections subject to flexure and diverging when unflexed at a first angle and being subject to flexure to form a second angle which is relatively acute with respect to said first angle, the wire on each side of said head portion including a pair of relatively parallel intermediate sections and a pair of crossing end sections prebent to gradually converge into crossing ends, the crossing ends spanning at least one of said filaments upon insertion into selected openings between said crossing wires and being movable into positions in which the end sections are substantially parallel to the long axis of the gasket and the intermediate sections are in crossing relationship upon flexure of the first wire sections to said relatively acute angle.

* * * * *